US006778956B1

(12) United States Patent
Sasaki et al.

(10) Patent No.: US 6,778,956 B1
(45) Date of Patent: Aug. 17, 2004

(54) VOICE RECORDING-REPRODUCING SYSTEM AND VOICE RECORDING-REPRODUCING METHOD USING THE SAME

(75) Inventors: Hiroshi Sasaki, Tokyo (JP); Masayasu Sato, Tokyo (JP)

(73) Assignee: OKI Electric Industry Co., Ltd., Tokyo (JP)

( * ) Notice: Subject to any disclaimer, the term of this patent is extended or adjusted under 35 U.S.C. 154(b) by 845 days.

(21) Appl. No.: 09/688,139

(22) Filed: Oct. 16, 2000

(30) Foreign Application Priority Data

Mar. 2, 2000 (JP) ..... 2000-057087

(51) Int. Cl.[7] ..... G10L 19/00
(52) U.S. Cl. ..... 704/230; 704/201; 704/229
(58) Field of Search ..... 704/200, 201, 704/260, 212, 230, 229, 219

(56) References Cited

U.S. PATENT DOCUMENTS 5,694,518 A * 12/1997 Takahashi et al. ..... 704/212
5,845,240 A * 12/1998 Fielder ..... 704/201
5,873,058 A * 2/1999 Yajima et al. ..... 704/201
6,373,421 B2 * 4/2002 Uchiyama et al. ..... 341/155
6,665,641 B1 * 12/2003 Coorman et al. ..... 704/260

OTHER PUBLICATIONS

An Algorithm for vector Quantizer Design; Yoseph Linde et al., "IEEE Transactions on Communications", vol. Com 28, No. 1, Jan. 1980.

* cited by examiner

*Primary Examiner*—Vijay Chawan
(74) *Attorney, Agent, or Firm*—Rabin & Berdo, P.C.

(57) ABSTRACT

Code patterns are first sorted in a codebook in order of power, and catalogued while preparing fixed parameters indicating a selection range size of the code patterns (not greater than values recordable in an analog flash memory), and a variable parameter indicating an offset amount of a selection range, from the leading edge of the codebook. When selecting a waveform, such selection is made from among the code patterns within the selection range, and the selection range is shifted to the optimal position by sequentially renewing the offset amount on the basis of a code number resulting from encoding of a preceding frame, and is then decided upon.

6 Claims, 11 Drawing Sheets

(FIRST EMBODIMENT) BLOCK DIAGRAM (FIRST EMBODIMENT) BLOCK DIAGRAM (FIRST EMBODIMENT)
PROCEDURE FOR CREATING A CODEBOOK (FIRST EMBODIMENT) EXAMPLE OF SORTING OF A CODEBOOK (LEFT SIDE : BEFORE SORTING,
RIGHT SIDE : AFTER SORTING )

(FIRST EMBODIMENT) MAKEUP OF A CODEBOOK AND SCHEMATIC FLOW OF PROCESSING FOR SWITCHOVER OF A SELECTION RANGE (FIRST EMBODIMENT) SELECTION OF WAVEFORM AND SWITCHOVER OF CODE PATTERN SELECTION RANGE (SECOND EMBODIMENT) BLOCK DIAGRAM (SECOND EMBODIMENT) MAKEUP OF CODEBOOK (SECOND EMBODIMENT) PROCEDURE FOR CREATING CODEBOOKS (SECOND EMBODIMENT) EXAMPLE OF LEARNING DATA DIVISION (SECOND EMBODIMENT) SCHEMATIC FLOW OF PROCESSING FOR SWITCHOVER OF CODEBOOK (SECOND EMBODIMENT) FLOW OF PROCESSING FOR SELECTION OF WAVEFORM AND SWITCHOVER OF CODEBOOKS

VOICE RECORDING-REPRODUCING SYSTEM AND VOICE RECORDING-REPRODUCING METHOD USING THE SAME

BACKGROUND OF THE INVENTION

1. Field of the Invention

The invention relates to a voice recording-reproducing system for improving encoding efficiency by combining vector quantization with an analog flash memory, and a voice recording-reproducing method using the same.

2. Description of the Related Art

There has recently been seen marked invigoration and rapid growth in a market for a voice data recording-reproducing system. This is due to the fact that a voice data recording-reproducing technique is satisfying users' needs as a business tool such as an IC recorder, and the like, or as one of add-on functions of a radio, and the like, because of lengthening of recording-reproducing time, and lowering of the cost of a voice recording-reproducing system.

In the case of the above-described voice recording-reproducing system serving as the business tool such as the IC recorder, and the like, lengthening of recording time and enhancement of voice quality have become indispensable keywords, and have been achieved due to rapid progress made recently in a high efficiency compression encoding technique. Since the high efficiency compression encoding technique requires massive processing of complex and highly digitized signals of voice data, use of a high-speed high-performance LSI for exclusive use in processing the signals becomes essential conditions for carrying out the technique. As a result, the cost of the voice recording-reproducing system in whole tends to go up.

On the other hand, in the case of the voice recording-reproducing system serving as one of the add-on functions of a radio, and the like, lowering the cost of the voice recording-reproducing system becomes essential conditions in order to check the price of a merchandise itself using the same, leaving problems of lengthening recording time and enhancing voice quality unresolved. It becomes necessary therefore to develop techniques for recording and reproducing voice by use of a simple circuitry and configuration, avoiding complex and highly digital signal processing as much as possible.

In a market for a low priced voice recording-reproducing system, there is now available a voice recording-reproducing system wherein voice data are recorded in an analog flash memory, and are reproduced as necessary. The system comprises a low-pass filter for anti-aliasing, an analog flash memory for recording input signals which have passed through the filter, and a controller for controlling these components. The system performs operations comprising the following steps, respectively:

(Operation at the Time of Recording)

(R1) the step of receiving voice signals from a voice data input equipment such as a microphone or the like;

(R2) the step of passing input voice data through the low-pass filter for anti-aliasing. This filter is a filter for prevention of aliasing by limiting a voice band for recording;

(R3) the step of the controller sampling the voice data which have passed through the filter according to a preset cycle (at a sampling frequency), thereby acquiring sampling voice data; and (R4) the step of the controller recording electric charge, corresponding to a value of the sampling voice data acquired, in the analog flash memory, thereby recording one sample value of the input voice data in one unit of analog flash.

Processing by the steps (R1) to (R4) as described above are repeated until the input voice data come to an end, recording all the sampling voice data in the analog flash memory.

(Operation at the Time of Reproduction)

(P1) the step of the controller acquiring values of electric charge, recorded in the analog flash memory; and (P2) the step of the controller converting the values into a voice waveform at the preset sampling frequency as with the case of recording, and transferring the voice waveform to the low-pass filter (the voice waveform at this stage takes a staircase-like shape, and is reverted to an original smooth waveform after passed through the low-pass filter).

The processing as above describes the operations of the voice recording-reproducing system using the analog flash memory.

(Problems Associated with Lengthening of Recording Time)

When a thought is given to recording voice for long hours by use of the voice recording-reproducing system, a first conceivable method is to increase a memory capacity. More specifically, this is a method of lengthening a recording time by adding a memory for recording "an increment of recording time x data at a sampling frequency" and further by adding "a controller for controlling the memory added on", that is, by modifying the configuration of the system. With this method, however, upon application of an IC, an area for mounting the IC will increase, thus resulting in an increase in the cost of the system.

As a voice recording method for long hours without increasing a memory capacity, a method of compressing voice data by use of encoding techniques is conceivable. This is a method whereby a data capacity is rendered smaller by efficiently encoding voice data instead of recording the voice data in original state, that is, by converting the voice data into other data without impairing the original quality of the voice data, thereby achieving lengthening of recording time. With a high efficiency compression encoding method as represented by the CELP scheme, and so forth, it is possible to prevent an increase in a memory capacity, however, in this case, processing of massive operation is required for encoding and decoding, so that there will arise needs for a LSI having a high processing capacity, thus resulting in an increase in the cost, all the same.

(A Conventional Voice Recording-reproducing System Using the Vector Quantization Technique)

There is available a vector quantization (VQ) method as a coding method with a relatively small amount of operation that can be considered for use in combination with a voice recording-reproducing system ("An Algorithm for Vector Quantizer Design" by Yoseph Lin de et. al., IEEE TRANSACTION ON COMMUNICATIONS, vol. COM-28, No. 1, January, 1980). The conventional voice recording-reproducing system using the VQ method is described hereinafter. The system comprises a low-pass filter for anti-aliasing, a controller for controlling the whole system, a memory for storing recorded data, a VQ processor for encoding voice data, a codebook, and so forth. The codebook is a frame waveform dictionary wherein standard patterns for a plurality of frame waveforms are catalogued.

There is available "LBG algorithm" as one of typical existing methods of creating the frame waveform dictionary.

The LBG algorithm is an algorithm with which the frame waveform dictionary can be easily created from actual voice data, and which can be divided broadly into the following two operations; that is, (a) a half-split process of centroids (corresponding to a waveform pattern), and (b) an optimization process.

Simply put, this is a method of creating the frame waveform dictionary by starting from preparing an initial centroid on the basis of learning data, and alternately repeating the processes (a), and (b) as described above until a required number of centroids are calculated.

The VQ method has the following advantages:

(a) a data space can be rendered smaller by converting a plurality of successive sample data into one pattern number, that is, by encoding (compression effect); and (b) the method can be implemented with relative ease simply by providing means of handling the plurality of the sample data as one frame waveform, and means of retrieving a pattern similar to the frame waveform among waveform patterns catalogued in the frame waveform dictionary.

However, since the method has the following problems, these techniques can not be easily combined.

(a) A large number of frame waveforms need to be catalogued in the frame waveform dictionary in order to perform high-quality recording and reproduction with the use of the VQ method.

(b) There is the upper limit to the number of values stored in one cell (that is, the upper limit to resolutions) owing to the nature of the analog flash memory. For this reason, code values that can be stored in one cell are limited (the number of waveform patterns that can be catalogued in the frame waveform dictionary is limited).

Accordingly, simple combination of the VQ method with the voice recording-reproducing system will cause a problem of degradation in the quality of voice data to be recorded. It is conceivable therefore as a method of resolving the problem described above to increase the number of the waveform patterns catalogued in the frame waveform dictionary, and at the same time, to store waveform numbers of the waveform patterns in a plurality of cells instead of one cell. For example, there is a method of preparing a plurality of the frame waveform dictionaries. More specifically, it is a method whereby a small number of waveform patterns are catalogued in each one of the frame waveform dictionaries, and input voice data are encoded into two types of values, that is, the numbers of the respective frame waveform dictionaries, and the numbers of waveform patterns, thereby inhibiting degradation in the voice quality.

With this method, the number of the waveform patterns that can be catalogued in each of the frame waveform dictionaries can be reduced, however, when encoding one sample data, the sample data need to be converted into a plurality of code data, that is, a code number and a codebook number, thus resulting in a lower data compression ratio.

SUMMARY OF THE INVENTION

It is an object of the invention to provide a voice recording-reproducing system capable of maintaining high encoding efficiency by solving problems associated with combining the VQ method with an analog flash memory, and a voice recording-reproducing method using the same.

To this end, with the voice recording-reproducing system according to the invention, code patterns are first sorted on a codebook in order of power, and catalogued while preparing fixed parameters indicating a selection range size of the code patterns (not greater than values recordable in an analog flash memory), and a variable parameter indicating an offset amount of the selection range, from the leading edge of the codebook.

When selecting a waveform, such selection is made from among the code patterns within the selection range, and the selection range is shifted to the optimal position by renewing an offset amount which is calculated on the basis of a code number resulting from encoding of a preceding frame, and is decided upon.

DESCRIPTION OF THE PREFERRED EMBODIMENTS

First Embodiment

With a first embodiment of a voice recording-reproducing system according to the invention, code patterns are sorted on a codebook in order of power, and catalogued while preparing fixed parameters indicating a selection range size of the code patterns (not greater than values recordable in an analog flash memory), and variable parameters indicating offset amounts of selection range, from the leading edge of the code book.

When selecting a waveform, such selection is made from among the code patterns within the selection range, and the selection range is shifted to the optimal position by renewing an offset amount on the basis of a code number resulting from encoding of a preceding frame. By so doing, it is possible to encode within limitations of the analog flash memory, and to improve coding efficiency because an amount of codes other than code numbers is not employed.

Figure 1:
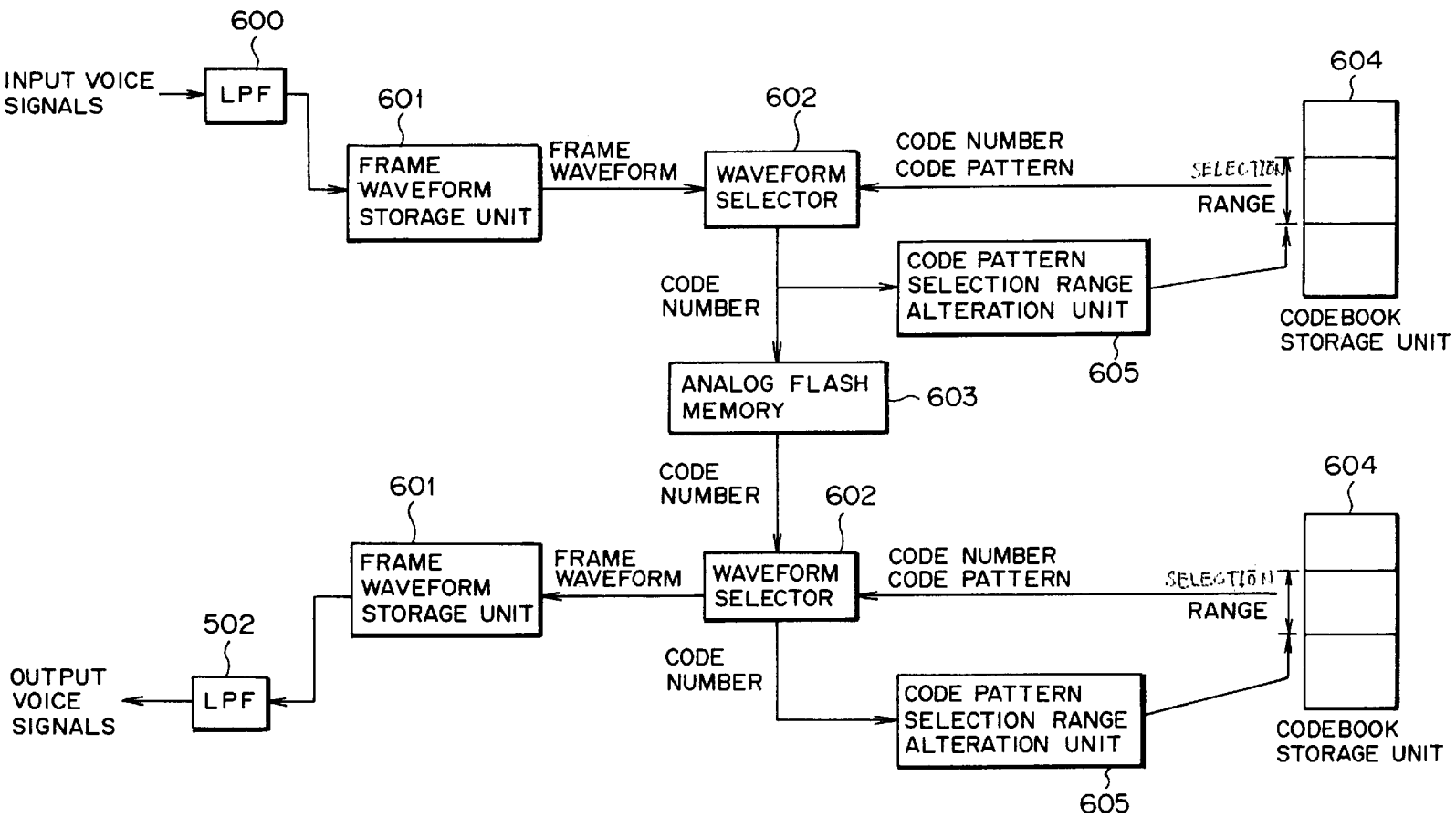
FIG. 1 is a block diagram showing a first embodiment of a voice recording-reproducing system according to the invention.

FIG. 1 is a block diagram of the first embodiment of the voice recording-reproducing system according to the invention. The first embodiment comprises a low-pass filter 600 for anti-aliasing, a frame waveform storage unit 601 for sampling voice signals according to a preset sampling frequency, and temporarily storing continuous sample data in number equal to a preset form length as a frame waveform, a codebook storage unit 604 for cataloging a large number of code patterns as standard patterns of frame waveforms, a waveform selector 602 for selecting a code pattern most similar to the previously-described frame waveform among the code patterns cataloged in the codebook, an analog flash memory 603 for recording a code number corresponding to the code pattern selected by the waveform selector 602, and a code pattern selection range alteration unit 605 for altering a selection range in the codebook with the results of encoding of a preceding frame.

The codebook storage unit comprises one codebook wherein a large number of the code patterns are cataloged, and a buffer for storing selection range sizes W, and offset amounts B of the selection range, from the leading edge of the codebook. The codebook is comprised of "N" code numbers (digital values) and "N" code patterns (one code pattern is made up of "L" digital values), the code numbers corresponding to the code patterns on a one-to-one basis. The selection range size W is a parameter indicating the width of a range where the code patterns are retrievable when encoding a target frame while the offset amount B is a parameter indicating position in the codebook from which a present selection range begins. Further, the code patterns cataloged in the codebook have been sorted in order of power beforehand, and internal code numbers are allocated such that a code pattern of the smallest power is assigned 1, and other patterns are assigned a number increasing by 1, respectively, in order of increasing power (refer to FIG. 4).

First, operation at the time of recording is described hereinafter.

(a1) Input voice signals are converted into sampling data at a preset time interval (the reciprocal of the sampling frequency) by the frame waveform storage unit 601.

(a2) The frame waveform storage unit then buffers the sampling data until the number thereof becomes equal to the preset frame length L, and transfers the same in the form of a frame waveform to the waveform selector 602 when the number has reached L.

(a3) The waveform selector 602 selects a code pattern most similar to the frame waveform from among a plurality of the code patterns within the selection range of the codebook storage unit 604, set by the code pattern selection range alteration unit, and acquires a code number allocated to the code pattern.

(a4) The code number acquired is converted into an analog value (an amount of electric charge) corresponding to the code number by the agency of a D/A converter (not shown), and is written to the analog flash memory 603. As a result, "L" pieces of voice sampling data are compressed and recorded in the analog flash memory.

(a5) The waveform selector 602 transfers the code number (digital value) to the code pattern selection range alteration unit 605 as well in order to renew the code pattern selection range for encoding succeeding frame.

(a6) The code pattern selection range alteration unit 605 alters the code pattern selection range on the basis of the code number inputted. This processing step being central to this embodiment of the invention, further description in detail will be given later.

(a7) Processing by the steps (a1) to (a6) as described above are repeated until the input voice signals come to an end.

By taking the steps as above for processing, recording is completed.

Next, operation at the time of reproduction is described hereinafter.

(b1) The waveform selector 602 acquires the code number of a first frame from the analog flash memory 603. Since the code number is recorded in the form of electric charge (analog value) on the analog flash memory, the code number is converted into a digital code number corresponding to the amount of the electric charge before being acquired.

(b2) The waveform selector 602 acquires a code pattern to which the acquired code number is allocated from the codebook storage unit 604. However, the acquired code number is a number within the selection range, the code number is converted into a number in the codebook by use of the offset amount of the selection range, and the size of the selection range before acquiring the code pattern.

(b3) The waveform selector 602 converts the code pattern as acquired into a frame waveform, and sending the frame waveform out to the frame waveform storage unit 601.

(b4) The frame waveform storage unit 601 converts the frame waveform into respective voice data inside a frame at a preset time interval, and sends the same out to the low-pass filter.

(b5) The voice data are passed through the low-pass filter so as to be smoothed out, whereupon voice signals are outputted.

Processing by the steps (b1) to (b5) as described above is repeated up to the last encoded data recorded in the analog flash memory. The foregoing is a processing procedure at the time of reproduction.

Now, processing at the code pattern selection range alteration unit is described in detail hereinafter with reference to FIGS. 4 and 5.

Figure 4:
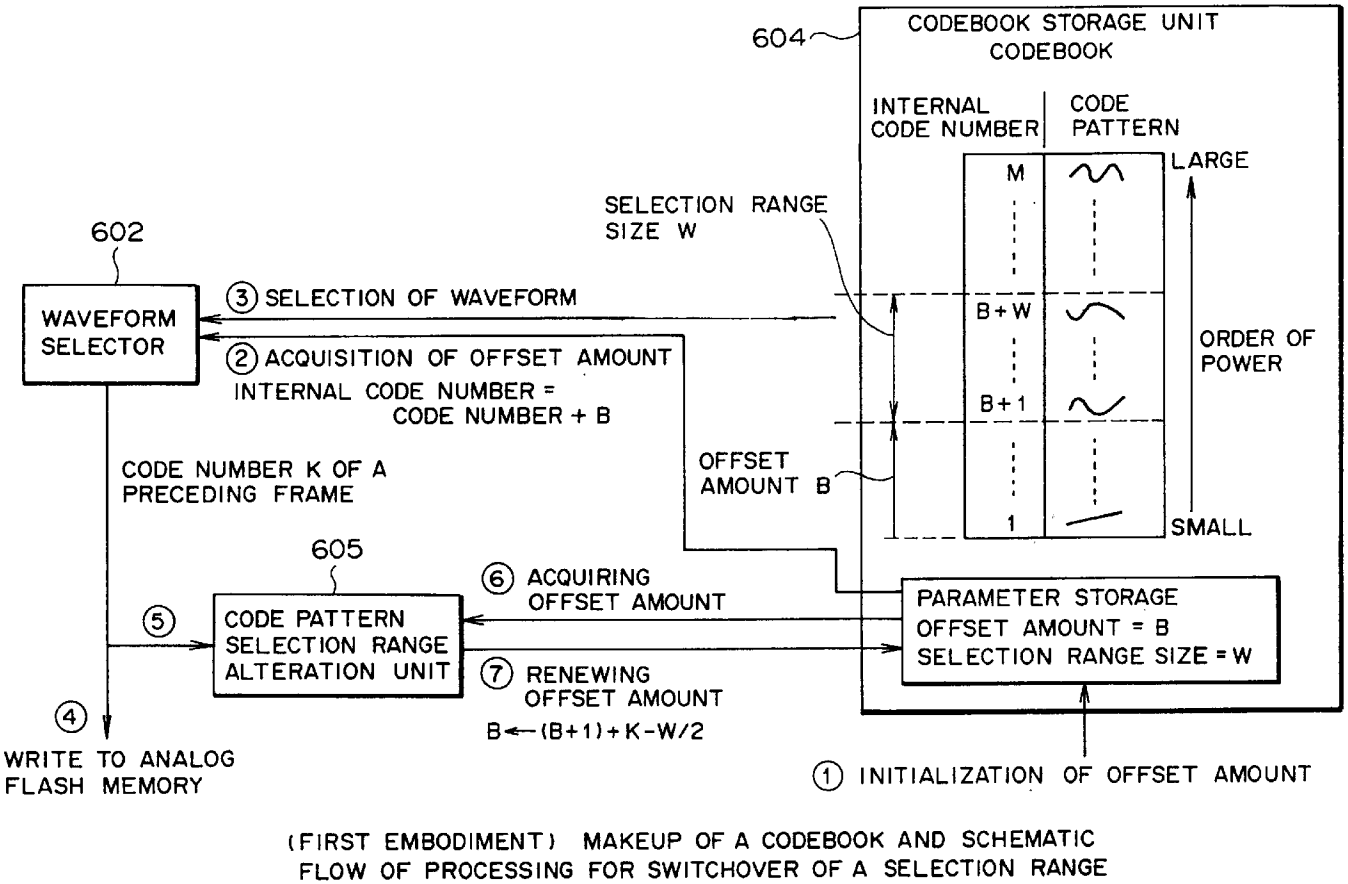
FIG. 4 is a schematic illustration showing the makeup of the codebook, and processing for switchover of a code pattern selection range, according to the first embodiment.
Figure 5:
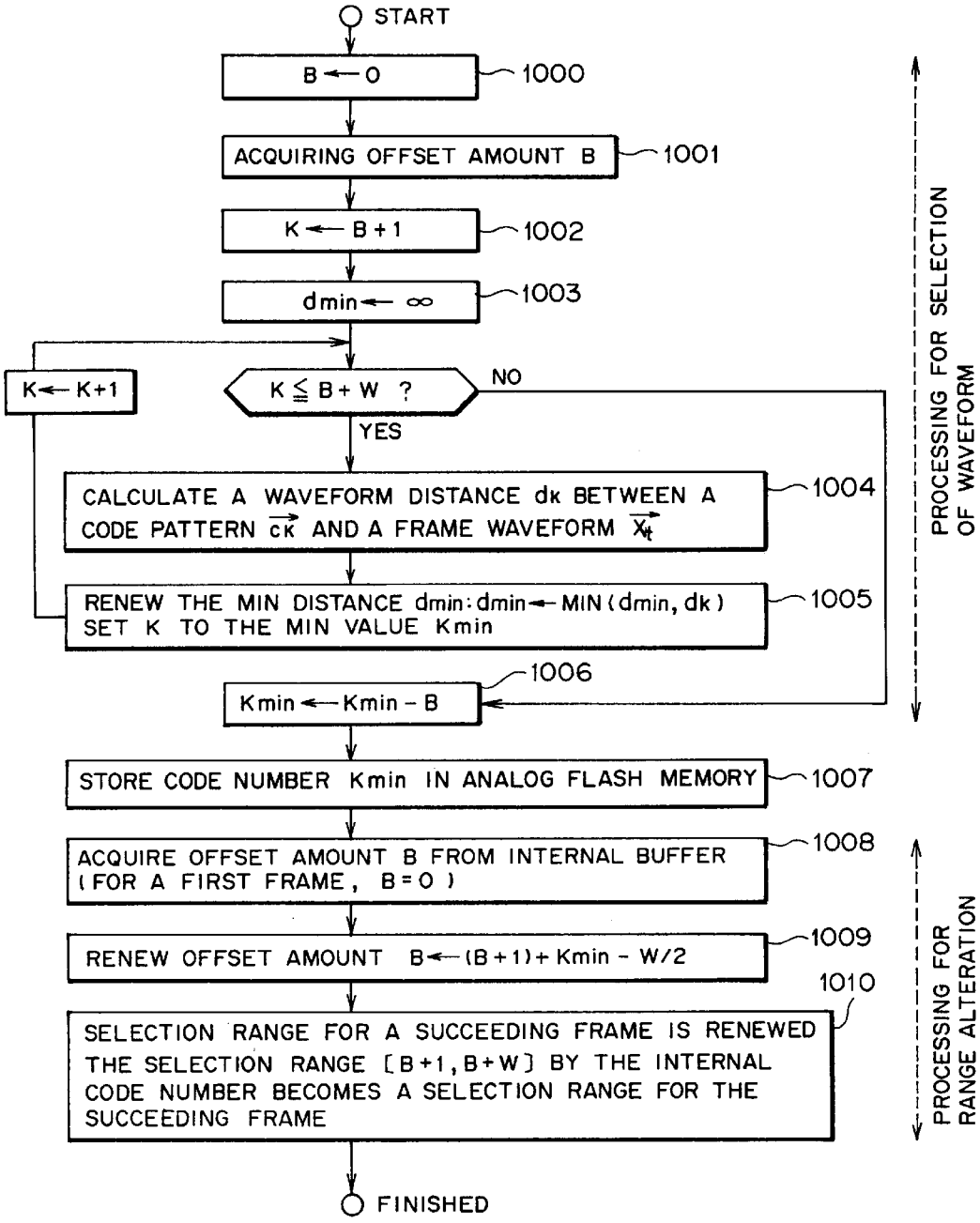
FIG. 5 is a flow chart showing a processing procedure for waveform selection and switchover of the code pattern selection range, according to the first embodiment.

(c1) The parameter indicating the offset amount B in the codebook storage unit is set to the initial value "0" {FIG. 4-(1), FIG. 5-1000}.

(c2) The waveform selector 602 acquires the offset amount B {FIG. 4-(2), FIG. 5-1001}.

(c3) The waveform selector 602 set a loop counter k that is required for processing of waveform selection to B+1 (FIG. 5-1002).

(c4) The waveform selector 602 initializes the minimum distance $d_{min}$ that is required for processing of waveform selection (FIG. 5-1003). The $d_{min}$ is a buffer for temporarily storing the minimum distance between the plurality of the code patterns and the frame waveforms, and in FIG. 5, the initial value thereof is shown to be infinite. However, this value need only be sufficiently larger than a distance value that can be taken in practice.

(c5) A waveform distance $d_k$ between a code pattern (vector $C_k$) and a frame waveform (vector $X_t$) is calculated by the following expression (FIG. 5-1004) wherein L is a frame waveform length, and in this embodiment, L=4:

$$d_k = \left\{ \sum_{i=1}^{L} (C_{k,i} - x_{t,i})^2 \right\} / L$$

(c6) The waveform distance $d_k$ as calculated is compared with the minimum distance $d_{min}$, and in the case of $d_k$ being smaller than $d_{min}$, the minimum distance $d_{min}$ is renewed, setting the loop counter k at this point in time to buffer $k_{min}$ (FIG. 5-1005).

(c7) The loop counter k is counted up, repeating the processing steps (c5) and (c6) as described above, and when the loop counter k has reached the upper limit B+W of a selectable range, a loop is completed In this embodiment, W=256.

(c8) The difference when the offset amount B is subtracted from a value of the buffer $k_{min}$ is a code number of a selected waveform {FIG. 5-1006; processing by the steps (c3) to (c7) as above correspond to FIG. -(3)}.

(c9) A code number $k_{min}$ as found is converted into an analog value (an amount of electric charge) by the agency of a D/A converter (not shown), and is written to the analog flash memory {FIG. 4-(4), FIG. 5-1007}.

(c10) The code number $k_{min}$ (digital value) is sent out to the code pattern selection range alteration unit 605 {FIG. 4-(5)}.

(c11) The code pattern selection range alteration unit 605 acquires the offset amount B from the codebook storage unit 604 {FIG. 4-(6), FIG. 5-1008}.

(c12) The offset amount B is renewed on the basis of the code number $k_{min}$ {FIG. 4-(7), FIG. 5-1009}.

(c13) As a result of processing by the step (c12), a selection range for a succeeding frame is shifted by $k_{min}$−W/2+1, and renewed, thus changing the selection range (FIG. 5-1010).

By taking the above-described processing steps in sequence, a selection range for every frame can be altered by use of the results of respective preceding frames.

Figure 2:
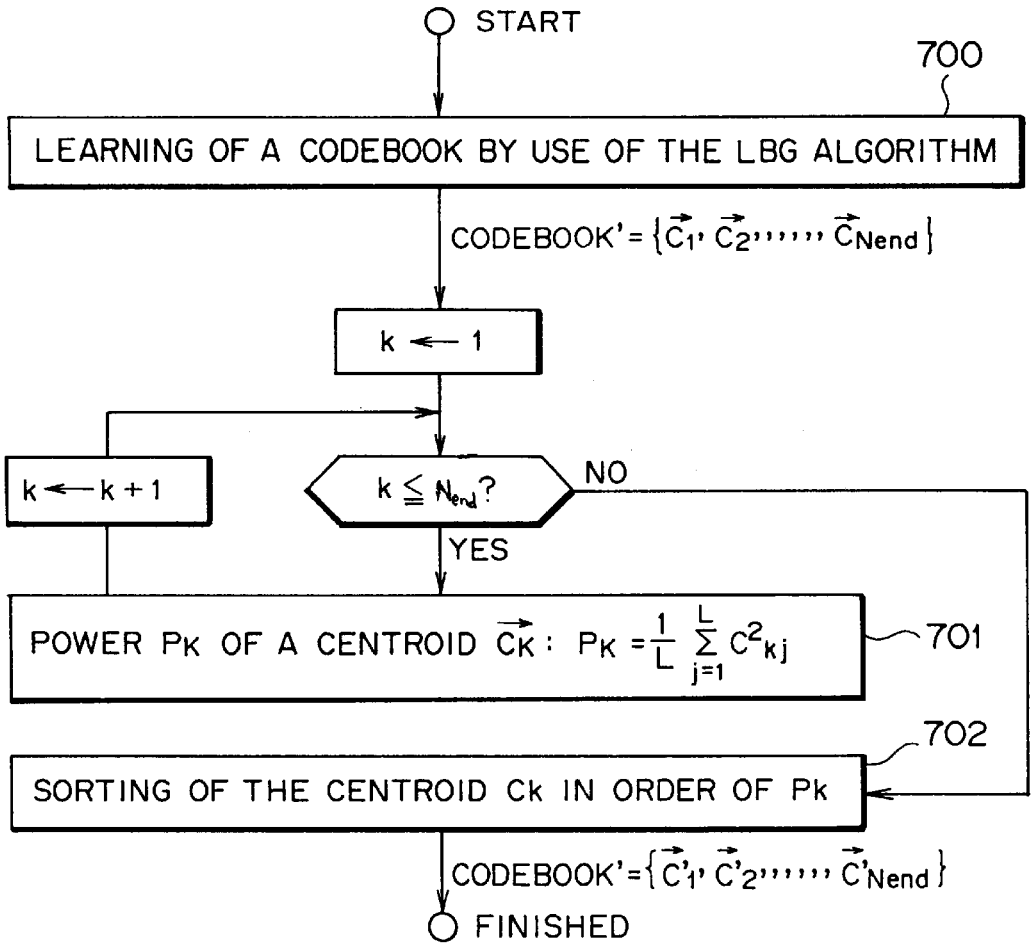
FIG. 2 is a flow chart showing a procedure for creating a codebook according to the first embodiment of the invention.

Next, a procedure for creating the codebook according to this embodiment is described hereinafter with reference to FIG. 2.

(d1) The codebook is created by use of the LBG algorithm (700).

(d2) Sorting of the codebook created is performed. More specifically, this is implemented by taking the following steps (d3) to (d6).

(d3) The loop counter k is set to an initial value 1.

(d4) A power $P_k$ of respective code patterns (vector $C_k$) in the codebook is calculated, and is stored in the buffer (701).

(d5) The loop counter k is counted up, repeating the processing step (d4) until the number of the code patterns reaches $N_{end}$.

(d6) The code patterns are sorted in order of the powers $P_k$ as calculated (702).

Figure 3:
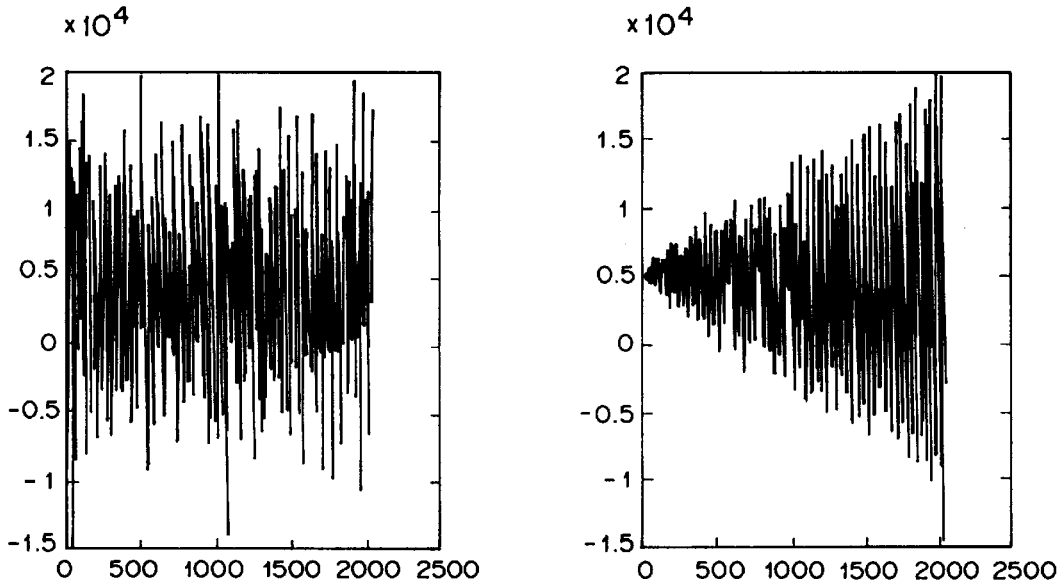
FIG. 3 is a view showing an example of code patterns rearranged on the codebook according to the first embodiment.

FIG. 3 shows an example of the codebook that can be created by the above-described procedure. In the figure, two charts are shown, one on the left side indicating the codebook before sorting, and the other on the right side indicating the codebook after sorting. With the respective charts, the vertical axis indicates waveform amplitude values, and the horizontal axis sample numbers. However, waveforms of sample numbers from 1 to L along the direction of the horizontal axis represent a code pattern with a code number 1, and waveforms of succeeding sample numbers from L+1 to 2L represent a code pattern with a code number 2, and so on, so that all the code patterns are arranged in order of successive code numbers. This shows that the codebook had been sorted.

As described in the foregoing, with the first embodiment of the invention, by sorting beforehand the codebook according to the power of the respective code patterns, providing two parameters (for the selection range size and the offset amount, respectively) for indicating selection range, which is selected at present, in the codebook storage unit, and renewing the parameter for the offset amount such that the code number resulting from encoding of respective preceding frames is at the center of the selection range, a code pattern in the vicinity of the power of a preceding frame can be used for the codebook for a succeeding frame, thereby enabling the selection range of a frame waveform to be automatically switched.

Since the selection range of the frame waveform can be automatically switched, it becomes possible to efficiently extract a code pattern necessary for encoding of a target frame among massive code patterns, so that lengthening of recording time can be realized while checking an increase in the cost.

Second Embodiment

With a second embodiment of the invention, learning data are first divided into a plurality of subclasses corresponding to the magnitude of power before creating codebooks, further a flag is set at the upper and lower edges of the respective codebooks, and the codebooks are allocated codebook numbers in order of average power of cataloged patterns. When selecting a waveform, the waveform is selected from among code patterns cataloged in a current codebook, and the current codebook is switched over to a optimal codebook to a succeeding frame by adding on to, or subtracting from the respective codebook numbers if the code number of a preceding frame exceeds, or falls short of a flag provided in the current codebook. By so doing, it is possible to encode within limitations of an analog flash memory, and to improve coding efficiency because of encoding code numbers only, so that previously described problems can be resolved.

Further, with the second embodiment, the learning data are divided into the plurality of subclasses before designing the codebooks, and consequently, it becomes possible to allocate more subclasses to spots of small power, and to allocate less subclasses to spots of greater power, thus contributing to improvement of voice quality in auditory sense.

Figure 6:
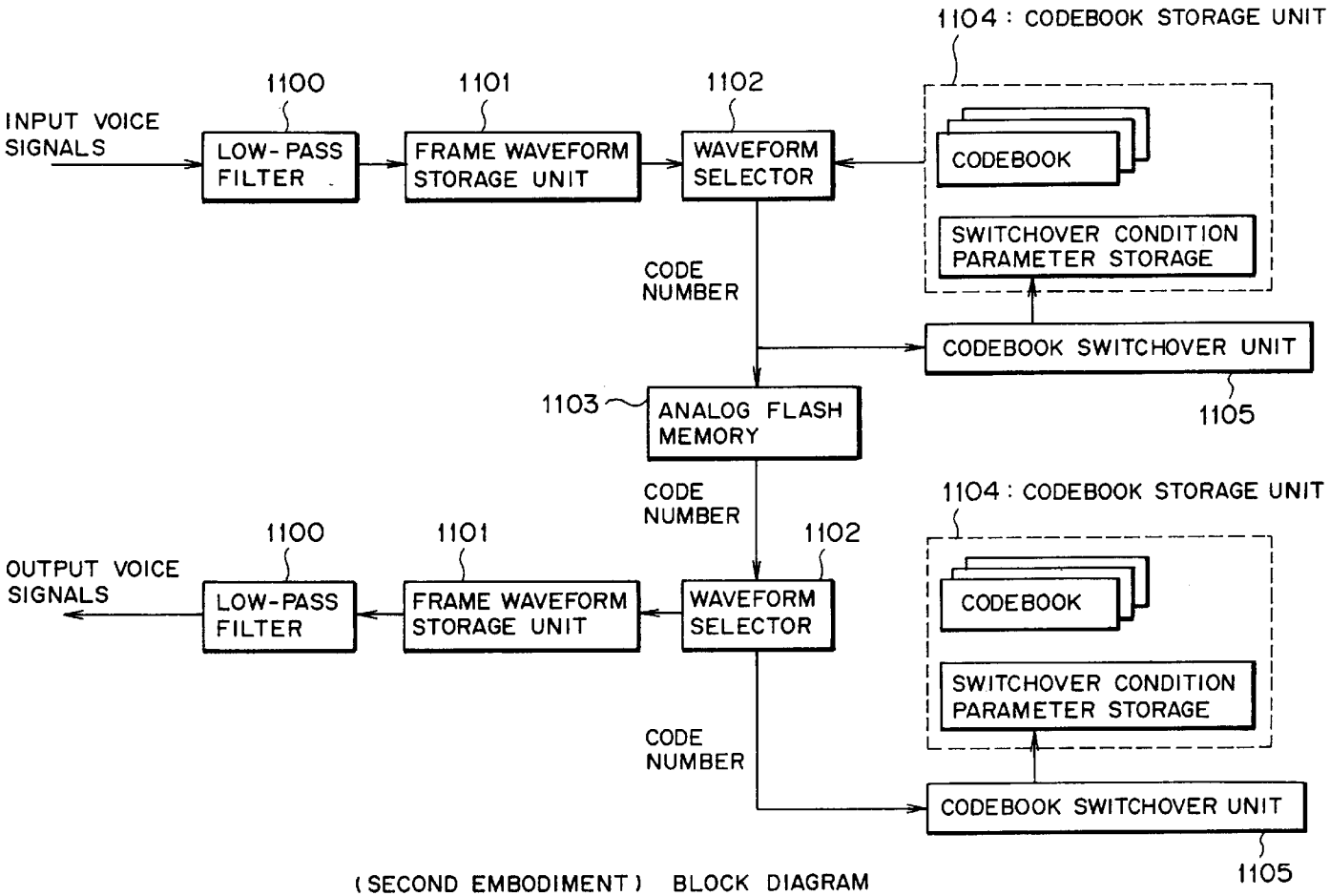
FIG. 6 is a block diagram showing a second embodiment of a voice recording-reproducing system according to the invention.

FIG. 6 is a block diagram of the second embodiment of a voice recording-reproducing system according to the invention. As shown in the figure, the second embodiment comprises a low-pass filter 1100 for anti-aliasing according to a preset sampling frequency, a frame waveform storage unit 1101 for sampling voice signals according to the preset sampling frequency, and temporarily storing successive sample data, in number equal to a preset form length of a frame waveform, a codebook storage unit 1104 for storing a plurality of codebooks in which standard patterns of the frame waveforms are cataloged, a waveform selector 1102 for selecting a code pattern most similar to the frame waveform among code patterns cataloged in the codebooks, an analog flash memory 1103 for recording code numbers, expressed in analog value, corresponding to the code patterns selected by the waveform selector, and a codebook switchover unit 1105 for selecting a succeeding codebook from among the codebooks in the codebook storage unit 1104 based on the results of encoding a preceding frame.

The codebook storage unit 1104 comprises a plurality of codebooks and a switchover condition parameter storage, and the number of a codebook in current use (referred to hereinafter as a current codebook number) and switchover condition parameters for a current codebook are stored in the switchover condition parameter storage. Further, in the respective codebooks, the code patterns cataloged therein are sorted in order of power, and are allocated a code number, respectively, setting a codebook number i and switchover condition parameters Li and Ui. The codebook number is an ID number for referring to a codebook from the current codebook number, representing numbers sequentially allocated from 1 up to the numbers stored in the codebook storage unit. Meanwhile, the switchover condition parameters are determining parameters for renewing the current codebook number; more specifically, parameters that are loaded into the switchover condition parameter storage when a codebook becomes the current codebook, adding 1 only to the current codebook number if the code number of a preceding frame is not less than Ui while subtracting 1 only from the current codebook number if the code number of a preceding frame is not more than Li (refer to FIG. 7). As with the case of the first embodiment, the respective codebooks are comprised of "N" code numbers (digital values) and "N" code patterns (one code pattern is made up of "L" digital values), the code numbers corresponding to the code patterns on a one-to-one basis.

First, operation at the time of recording is described hereinafter.

(e1) Input voice signals are restricted to pass through a preset pass-band only by the low-pass filter 1100 provided for the anti-aliasing purpose.

(e2) Sampling of waveform data is performed at a preset time interval (the reciprocal of a sampling frequency) in the frame waveform storage unit 1101. The data is used hereinafter as sampling data.

(e3) The frame waveform storage unit buffers the sampling data until the number thereof becomes equal to a preset frame length L, and transfers the same in the form of a frame waveform to the waveform selector 1102 when the number has reached L.

(e4) The waveform selector 1102 selects a code pattern most similar to the frame waveform from among code patterns cataloged in a current codebook within the codebook storage unit 1104, set by the codebook switchover unit 1105, and acquires a code number allocated to the code pattern.

(e5) The waveform selector 1102 converts the code number as acquired into an analog value (an amount of electric charge) by the agency of a D/A converter (not shown), and write the analog value to the analog flash memory 1103. As a result, "L" pieces of voice sampling data are compressed and recorded in the analog flash memory.

(e6) The waveform selector 1102 transfers the code number (digital value) to the codebook switchover unit 1105 as well in order to alter the codebook for encoding a succeeding frame.

(e7) The codebook switchover unit 1105 alters the codebook on the basis of the code number inputted. This processing step being central to this embodiment of the invention, further description in detail will be given later.

(e8) Processing by the steps (e1) to (e7) as described above is repeated until the input voice signals come to an end.

By taking the steps as above for processing, recording is completed.

Next, operation at the time of reproduction is described hereinafter.

(f1) The waveform selector 1102 acquires a code number of a first frame from the analog flash memory 1103. Since the code number is recorded in the form of electric charge on the analog flash memory, the same is converted into a digital code number corresponding to the amount of the electric charge by the agency of a A/D converter (not shown) before being acquired.

(f2) The waveform selector 1102 acquires a code pattern to which the code number is allocated from within the current codebook in the codebook storage unit.

(f3) The waveform selector 1102 converts the code pattern into a frame waveform, and sends the frame waveform out to the frame waveform storage unit 1101, further sending out the code number to the codebook switchover unit 1105.

(f4) The frame waveform storage unit 1101 converts the frame waveform into respective voice data within a frame at a preset time interval, and sends the same out to the low-pass filter 1100.

(f5) The voice data are passed through the low-pass filter so as to be smoothed out, thereby outputting voice signals.

(f6) The codebook switchover unit 1105 alters the codebook on the basis of the code number.

(f7) Processing by the steps (f1) to (f6) described as above is repeated until the last encoded data recorded in the analog flash memory is reached. The foregoing is a processing procedure at the time of reproduction.

Figure 8:
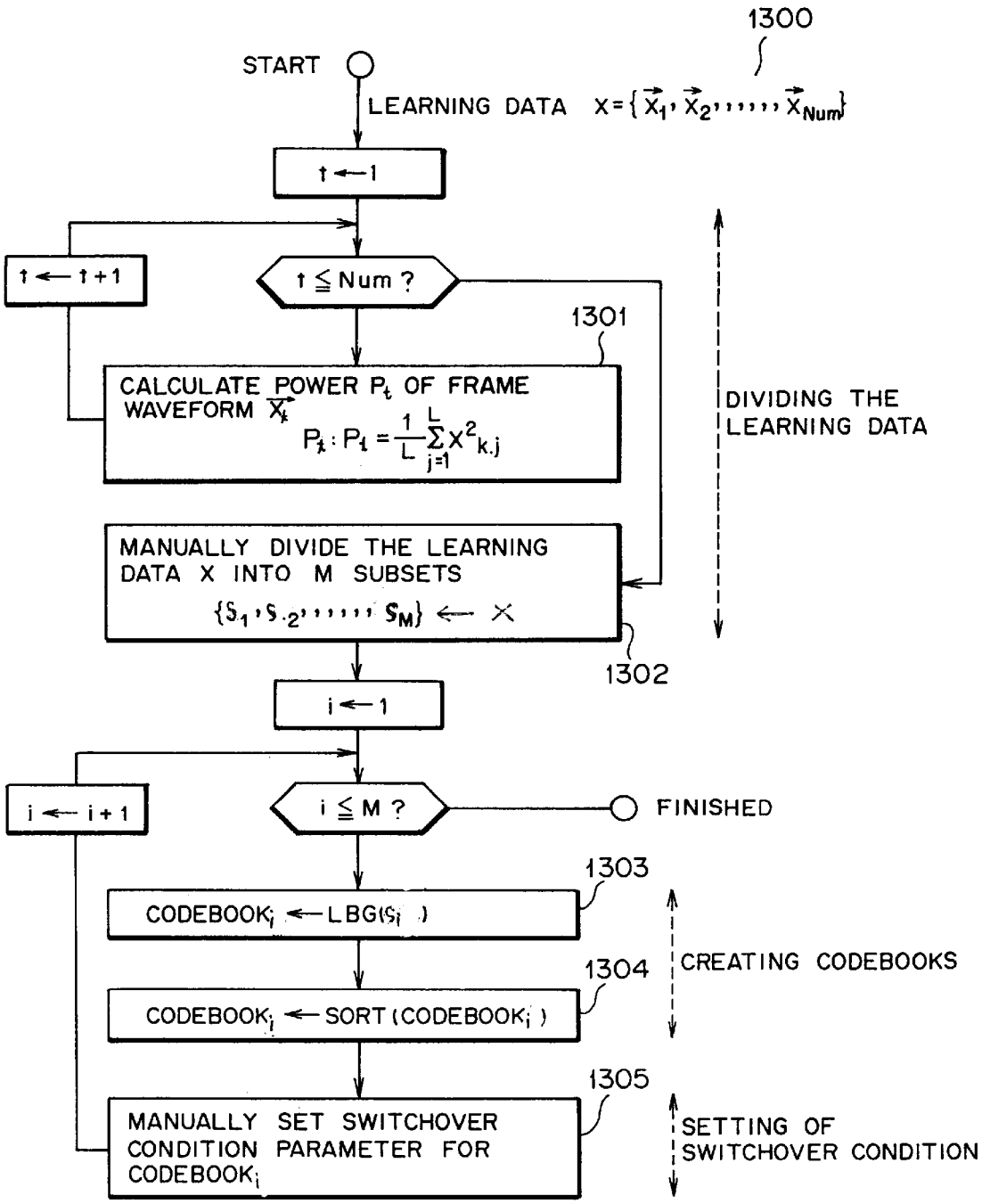
FIG. 8 is a flow chart showing a procedure for creating the codebooks according to the second embodiment of the invention.

Next, a procedure for creating the codebook according to this embodiment is described with reference to FIG. 8. The procedure for creating the codebook is broken down in three stages:

(a first stage) division of the learning data;

(a second stage) learning of the codebook by use of the LBG algorithm; and (a third stage) setting of the switchover condition parameters.

A procedure for creating the three stages as above is described hereinafter with reference to a flow chart in FIG. 8.

Figure 9:
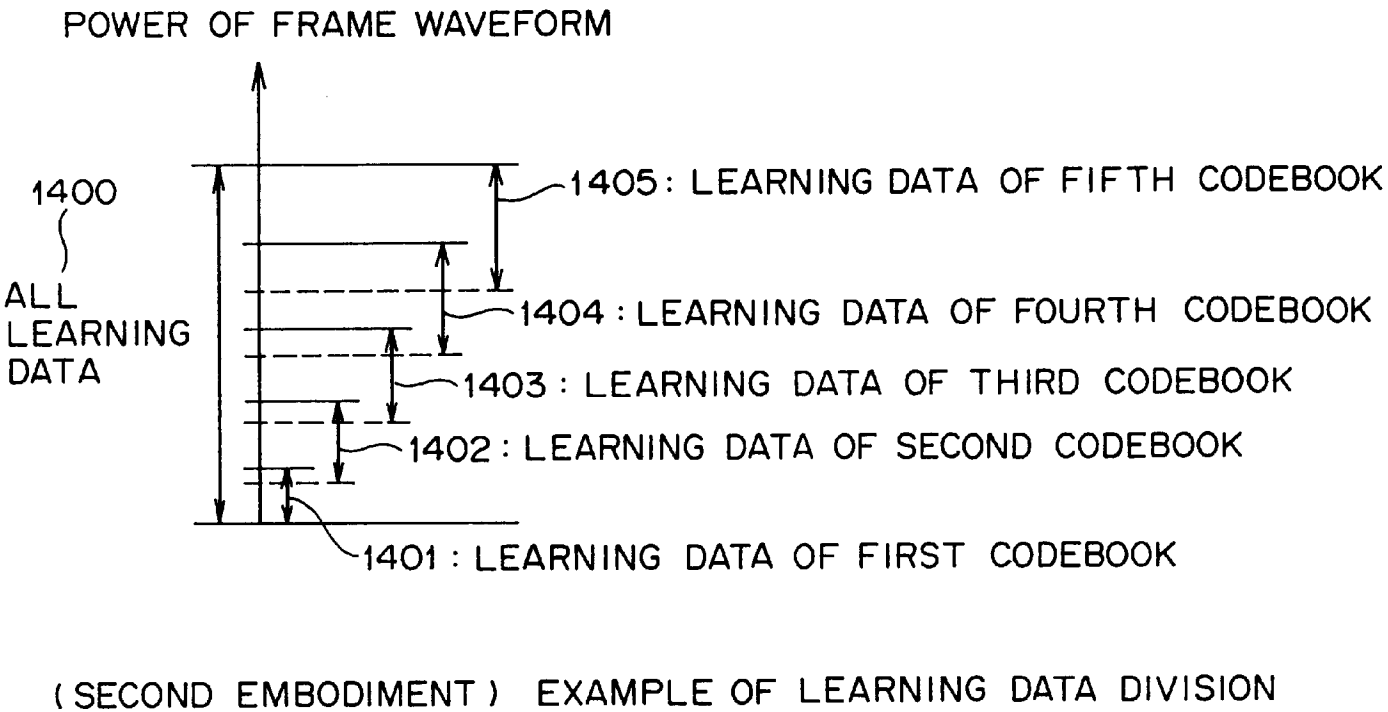
FIG. 9 is a view showing an example of learning data being divided according to the second embodiment of the invention.

(The First Stage) Division of the Learning Data:

(g1) As with the case of the first embodiment, actual voice data x are prepared as learning data (1300);

(g2) Powers $P_t$ of all frame waveforms (vector $x_t$) are calculated with a frame waveform as a unit (1301); and (g3) The learning data x are divided into "M" pieces of learning data set, each corresponding to the power of the respective frame waveforms, provided that the set of adjoining learning data set $s_i$ and $s_{i+1}$ are divided so as to have elements overlapping each other. More specifically, as shown in FIG. 9, the learning data are divided into five subclasses using an empirically set value as a threshold value, and if the power of a frame waveform contained in the learning data falls within a range of 1401, the frame waveform is classified into $s_1$, and if the power of a frame waveform contained in the learning data falls within a range of 1402, the frame waveform is classified into $s_2$, thus similarly classifying frame waveforms into $S_1$ to $S_5$, respectively (1302).

(The Second Stage) Learning of the Codebook by use of the LBG Algorithm:

(g4) A $\text{codebook}_1$ is created by use of the LBG algorithm on the basis of each of the M pieces of the learning data set. With this embodiment, the $\text{codebook}_1$ is created from $s_1$ in FIG. 9, a $\text{codebook}_2$ from $s_2$, a $\text{codebook}_3$ from $s_3$, a codebook$_4$ from $s_4$, and a codebook$_5$ from $s_5$ in sequence. Accordingly, a range of the power of the respective code patterns stored becomes greater in order of the codebook number (1303); and (g5) The code patterns cataloged in the respective codebooks created are sorted using the power of the respective code patterns as a key. A sorting procedure using the powers as the key is the same as the method according to the first embodiment (1304).

Figure 7:
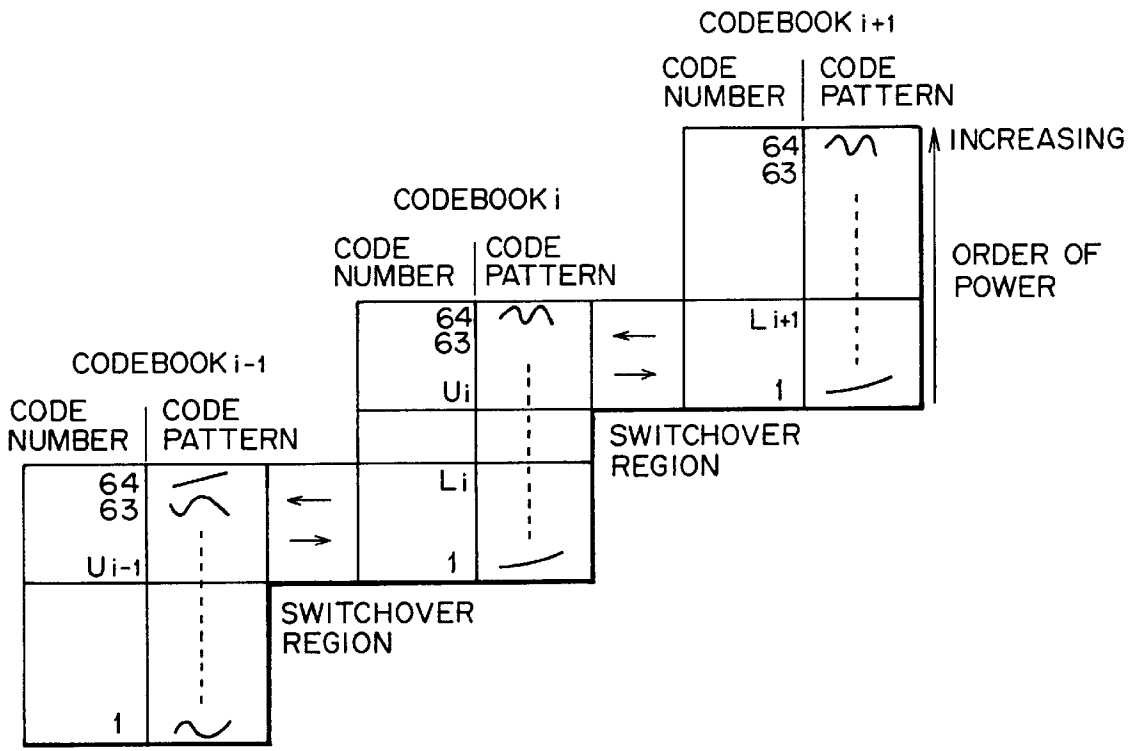
FIG. 7 is a schematic illustration showing the makeup of codebooks according to the second embodiment of the invention.

(The Third Stage) Setting of the Switchover Condition Parameters:

(g6) Finally, switchover condition parameters $U_i$ and $L_i$ for a codebook$_i$ are set. More specifically, a threshold value is set for the parameter $L_i$ such that a codebook$_{i-1}$ is able to inhibit quantized noises more than the codebook$_i$ if the code number of a preceding frame is not more than the parameter $L_i$ while a threshold value is set for the parameter $U_i$ such that a codebook$_{i+1}$ is able to inhibit quantized noises more than the codebook$_i$ if the code number of a preceding frame is not less than $U_i$. With this embodiment, as shown in FIG. 7, the threshold values are empirically set taking into account a histogram of the codebook patterns and powers of the codebooks actually created (1305).

Next, processing at the codebook switchover unit that is central to this embodiment is described in detail hereinafter with reference to FIGS. 10 and 11.

To start with, the codebook storage unit is described. The codebook storage unit incorporates ingenuity as described below in its configuration so that a codebook in current use (referred to hereinafter as the current codebook) can be automatically switched over.

(a) The codebook storage unit comprises a plurality of codebooks (sets of code patterns and internal code pattern numbers), and a buffer for storing a current codebook number "N", and current codebook switchover numbers "U", "L".

(b) As described previously, the respective code patterns cataloged in each of the codebooks have been sorted in order of power beforehand. The internal code pattern numbers are allocated such that an internal code pattern number allocated to a code pattern of the smallest power is assigned 1, and others are assigned a number increasing by 1 in order of power, respectively.

(c) The respective codebooks are arranged in order of power, and adjacent codebooks overlap each other in respect of power space in regions at the upper and lower ends thereof, the regions being set as switchover regions.

Next, a processing procedure is described hereinafter.

Figure 10:
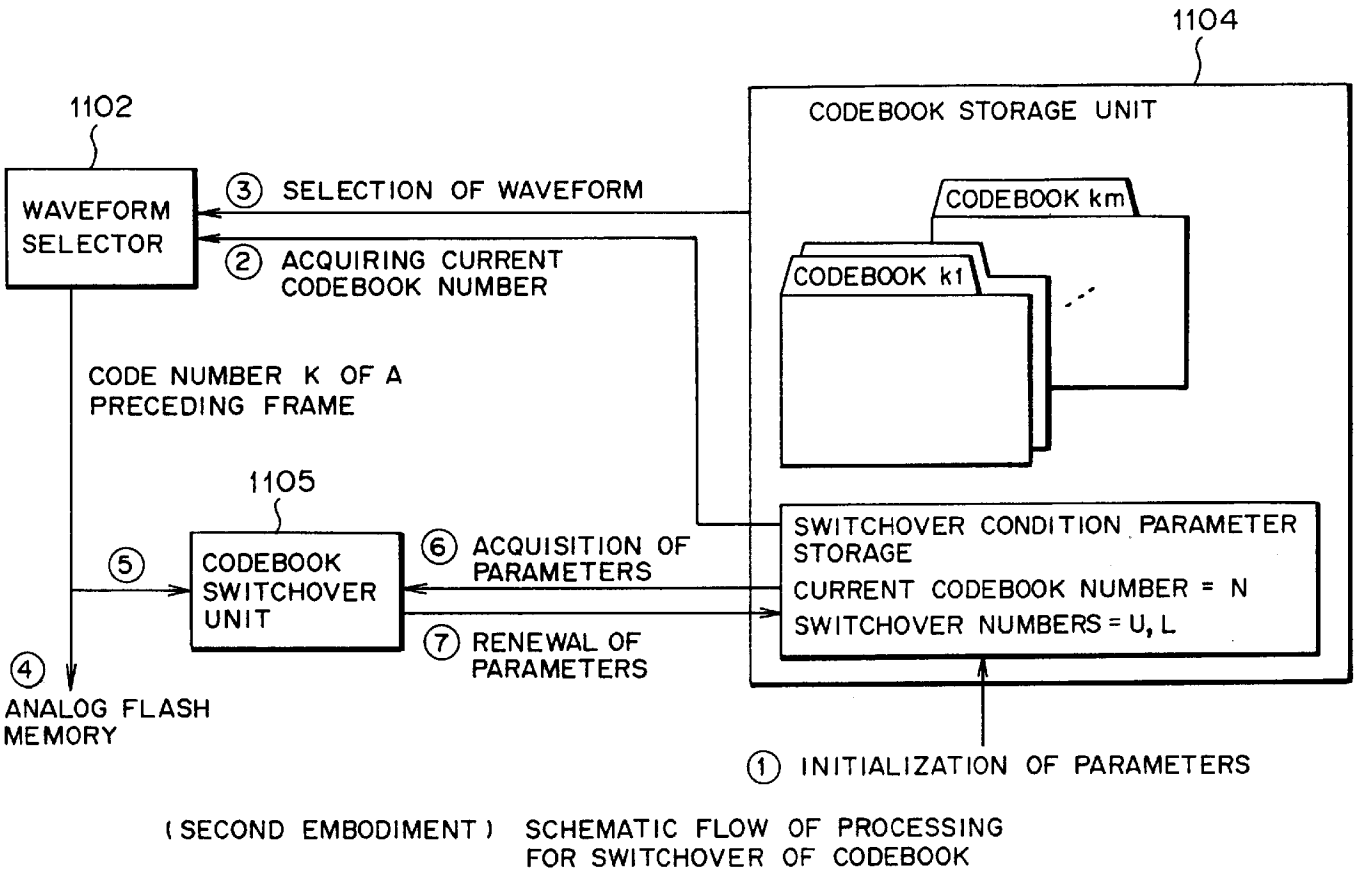
FIG. 10 is a schematic illustration showing a procedure for switchover of the codebooks according to the second embodiment of the invention.

(h1) The current codebook number N in the codebook storage unit is set to an initial value 0, and the current codebook switchover numbers "U", "L" are set to current codebook switchover numbers "$U_0$", "$L_0$", respectively {FIG. 10-(1)}.

Figure 11:
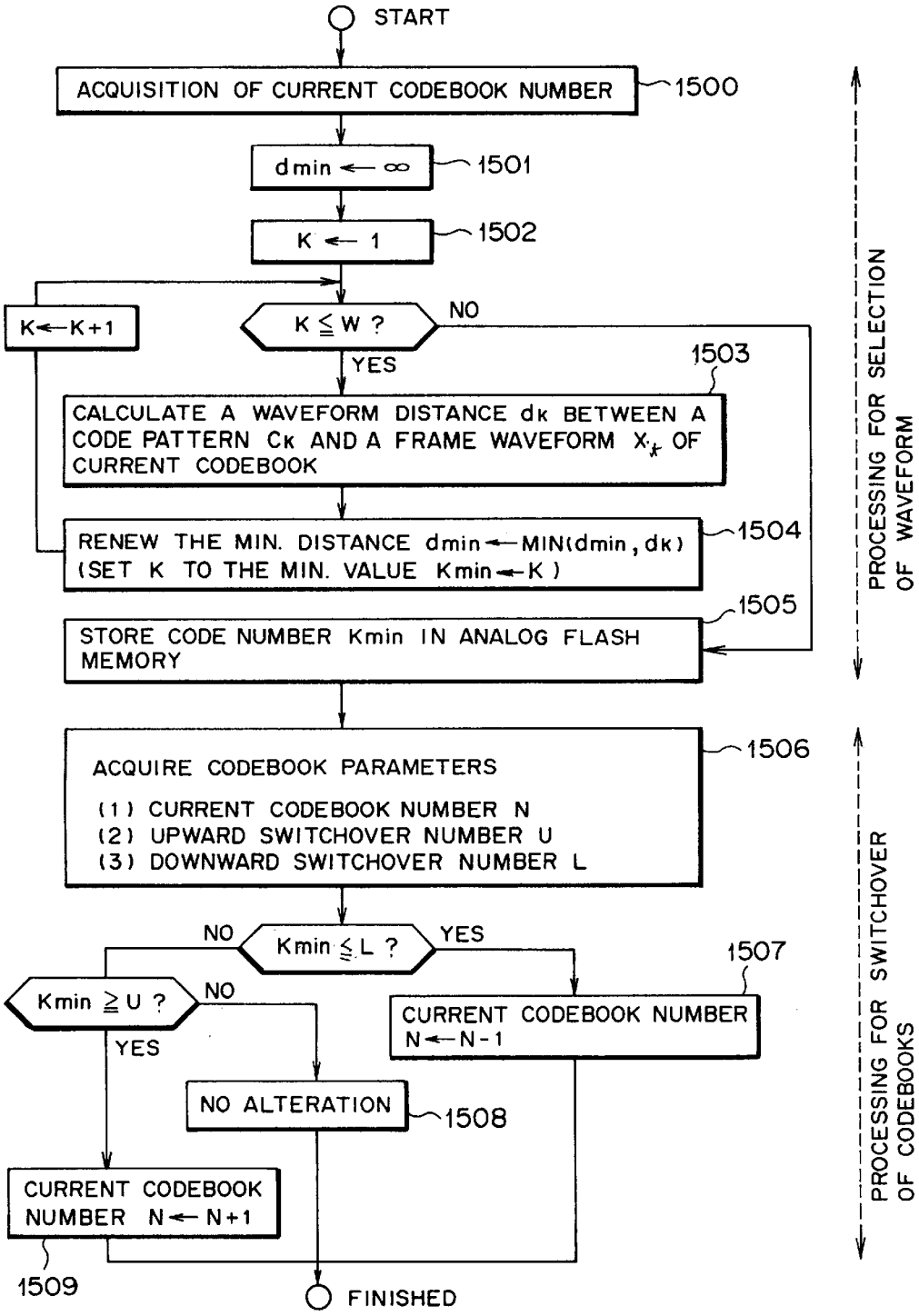
FIG. 11 is a flow chart showing a processing procedure for waveform selection and switchover of the codebooks, according to the second embodiment.

(h2) The waveform selector 1102 acquires the current codebook number "N" {FIG. 10-(2), FIG. 11-1500}.

(h3) The waveform selector 1102 initializes a distance $d_{min}$ that is required for processing of waveform selection (FIG. 11-1501). The distance $d_{min}$ is a buffer for temporarily storing the minimum distance between the plurality of the code patterns and the frame wave forms. In FIG. 11, an initial value thereof is shown to be infinite. However, this value need only be sufficiently larger than a distance value that can be taken in practice.

(h4) The waveform selector 1102 sets a loop counter k that is required for processing of waveform selection to 1 (FIG. 11-1502).

(h5) A waveform distance $d_k$ between a code pattern (vector $C_k$) and a frame waveform (vector $X_t$) of a current codebook is calculated (FIG. 11-1503). The waveform distance $d_k$ is calculated as a Euclidean distance as with the first embodiment. Herein, "L" is a frame waveform length, and in this embodiment, L=4:

(h6) The waveform distance $d_k$ is compared with the minimum distance $d_{min}$, and in the case of $d_k$ being smaller than $d_{min}$, the minimum distance $d_{min}$ is renewed, setting the loop counter k at this point in time to a buffer $k_{min}$ (FIG. 11-1504).

(h7) The loop counter k is counted up, repeating processing by the steps (h5) and (h6) as described above, and when the loop counter k reached a code pattern number "W" of the current codebook, a loop is completed. In this embodiment, W=256.

(h8) A code number $k_{min}$ as found is converted into an analog value by the agency of a D/A converter, and is written to the analog flash memory {FIG. 10-(4), FIG. 11-1505}.

(h9) The code number $k_{min}$ (digital value) is sent out to the codebook switchover unit {FIG. 10-(5)}.

(h10) The codebook switchover unit 1105 acquires the current codebook number "N", and the upward switchover number U as well as the downward switchover number "L" from the codebook storage unit 1104 {FIG. 10-(6), FIG. 11-1506}.

(h11) The code number $k_{min}$ of a preceding frame is compared with the downward switchover number "L" to determine which is greater, and in the case of the code number being smaller than "L", the difference when 1 is subtracted from the current codebook number "N" is set in the codebook storage unit {FIG. 10-(7), FIG. 11-1507}.

(h12) The code number $k_{min}$ of a preceding frame is compared with the upward switchover number "U" as acquired to determine which is greater, and in the case of the code number being greater than U, the sum of the current codebook number "N" and 1 is set in the codebook storage unit {FIG. 10-(7), FIG. 11-1509}.

(h13) If neither the case (h11) nor the case (h12) is applicable, renewal of the current codebook number is not performed (FIG. 11-1508).

By processing by the steps as described above, the codebook can be automatically switched over while referring to the encoding results of a preceding frame for every frame.

As described in the foregoing, with the second embodiment, the plurality of the codebooks are kept sorted in order of the power of the respective code patterns while causing adjacent codebooks to have the regions, each partially overlapping each other, setting the region as the switchover range, so that automatic switchover of the codebooks can be effected by rendering one of the adjacent codebooks as the codebook for a succeeding frame provided that the encoding results of the preceding frame are included in the region.

As a result of the automatic switchover, which has been made possible as described above, it is possible to efficiently extract code patterns required for encoding a target frame among massive code patterns, thereby enabling recording time to be lengthened while checking an increase in the cost.

Further, with the second embodiment, it is possible to freely design the category of respective codebooks by having the plurality of divided codebooks. That is, the learning range of a codebook can be rendered smaller at spots where sound is small while the learning range of a codebook can be rendered larger at spots where sound is loud. As a result, the smaller a sound made at spots where noises can be perceived with greater ease in auditory sense, the greater in detail learning can be done, so that this has an effect of improving voice quality in auditory sense because more code patterns can be prepared.

What is claimed is:

1. A voice recording-reproducing system comprising:

means of sampling voice signals on the basis of a preset sampling frequency;

frame waveform storage means of storing a plurality of sample data in succession as one frame waveform;

codebook storage means of storing a codebook for sorting standard patterns of the frame waveforms in order of power, and cataloging sets of the standard pattern as sorted and a pattern number, a selection range size for selecting a frame waveform from the codebook, and an offset amount of a selection range, from the leading edge of the codebook;

waveform selection means of selecting a code pattern most similar to an input frame waveform among code patterns cataloged in the codebook storage means;

means of converting a code number corresponding to the code pattern selected by the waveform selection means into an analog value, and recording the analog value in an analog flash memory; and code pattern selection range alteration means of renewing the offset amount of the selection range, on the basis of a code number resulting from encoding of a preceding frame.

2. A voice recording-reproducing method for recording voice, comprising the steps of:

(a) storing a codebook for sorting standard patterns of frame waveforms in order of power, and cataloging sets of the standard pattern as sorted and a pattern number, a selection range size for selecting a frame waveform from the codebook, and an offset amount of a selection range, from the leading edge of the codebook;

(b) sampling voice signals on the basis of a preset sampling frequency;

(c) creating one frame waveform from a plurality of sample data in succession;

(d) selecting a code pattern most similar to an input frame waveform from among a plurality of code patterns within a code pattern selection range of the codebook, and acquiring a code number allocated to the code pattern;

(e) converting the code number into an analog value, and recording the analog value in an analog flash memory;

(f) renewing the offset amount of the selection range on the basis of a code number resulting from encoding of a preceding frame; and (g) repeating processing by the above-described steps from (b) to (f) until input voice signals come to an end.

3. A voice recording-reproducing method for recording voice according to claim 2, wherein the step (f) of altering the code pattern selection range comprises the following sub-steps of:

(a) acquiring the offset amount B indicating a starting position of the code pattern selection range;

(b) substituting $(B+1)+k-W/2$ for the offset amount B provided that the code number corresponding to a frame waveform of the preceding frame is k, and a predetermined size of the selection range is W; and (c) altering a code pattern selection range for a succeeding frame to $[B+1, B+W]$.

4. A voice recording-reproducing system comprising:

means of sampling voice signals on the basis of a preset sampling frequency;

frame waveform storage means of storing a plurality of sample data in succession as one frame waveform;

codebook storage means of storing a plurality of codebooks cataloging standard patterns of the frame waveforms, sorted in increasing order of average power of cataloged patterns, a codebook number in current use, and switchover condition parameters for a codebook in current use;

waveform selection means of selecting a code pattern most similar to an input frame waveform from among code patterns cataloged in the codebook storage means;

means of converting a code number corresponding to the code pattern selected by the waveform selection means into an analog value, and recording the analog value in an analog flash memory; and code pattern selection range alteration means of renewing the codebook number through comparison of a code number resulting from encoding of a preceding frame with the switchover condition parameters for the codebook in current use.

5. A voice recording-reproducing method for recording voice, comprising the steps of:

(a) storing a plurality of codebooks cataloging standard patterns of frame waveforms, sorted in increasing order of average power of cataloged patterns, a codebook number in current use, and switchover condition parameters for a codebook in current use;

(b) sampling voice signals on the basis of a preset sampling frequency;

(c) creating one frame waveform from a plurality of sample data in succession;

(d) selecting a code pattern most similar to an input frame waveform among code patterns cataloged in the respective codebooks, and acquiring a code number allocated to the code pattern;

(e) converting the code number into an analog value, and recording the analog value in an analog flash memory;

(f) renewing the codebook number through comparison of a code number resulting from encoding of a preceding frame with the switchover condition parameters for the codebook in current use; and (g) repeating processing by the above-described steps from (b) to (f) until input voice signals come to an end.

6. A voice recording-reproducing method for recording voice according to claim 5, wherein the step (f) of renewing the codebook number, comprises the following sub-steps of:

(a) acquiring the switchover condition parameters for the codebook in current use, comprised of the codebook number "N" in current use, an upward switchover number "U", and a downward switchover number "L";

(b) comparing the code number k of the preceding frame with "L", and subtracting 1 from "N" if $k \leqq L$ while comparing k with "U" if $k>L$; and (c) adding 1 to "N" if $k \geqq U$ upon comparing k with "U", and keeping the value "N" unaltered if $k<U$.

* * * * *